US005267853A

United States Patent [19]

Arai

[11] Patent Number: 5,267,853

[45] Date of Patent: Dec. 7, 1993

[54] CURING DEVICE

[75] Inventor: Mitsuo Arai, Tokyo, Japan

[73] Assignee: Kabushiki Kaisha Shinkawa, Tokyo, Japan

[21] Appl. No.: 959,778

[22] Filed: Oct. 13, 1992

[30] Foreign Application Priority Data

Oct. 15, 1991 [JP] Japan ..... 3-293911

[51] Int. Cl.[5] ..... F27B 9/28

[52] U.S. Cl. ..... 432/59; 198/817; 414/157

[58] Field of Search ..... 198/809, 817; 414/157, 414/196; 432/8, 59

[56] References Cited

U.S. PATENT DOCUMENTS 4,217,090 8/1980 White et al. ..... 432/8
4,217,977 8/1980 Tam ..... 198/617 X
4,507,078 3/1985 Tam et al. ..... 198/817 X
4,591,044 5/1986 Ogami et al. ..... 198/817 X
4,874,081 10/1989 Kondo ..... 198/817 X
5,067,608 11/1991 McLellan ..... 198/817
5,168,978 12/1992 Cox et al. ..... 198/817 X

*Primary Examiner*—William E. Tapolcai
*Attorney, Agent, or Firm*—Koda and Androlia

[57] ABSTRACT

A curing device, which hardens on heater blocks a paste used for die-bonding the chips to lead frames, including frame supporting wires, wire slacking preventing collars and frame conveying wires. The frame supporting wires are installed above the heater blocks and parallel to the feeding direction of the lead frames, and the wire slacking preventing collars are mounted on the frame supporting wires so that a constant space is retained between the frame supporting wires and the heater blocks. The lead frames are fed and placed on the frame supporting wires when the frame conveying wires, which are movable vertically, is moved down, so that the pastes is heated by the heater blocks.

6 Claims, 2 Drawing Sheets

CURING DEVICE

BACKGROUND OF THE INVENTION

1. Field of the Invention

The present invention relates to a curing device used, for example, in a semiconductor manufacturing apparatus.

2. Prior Art

Lead frames to which chips have been die-bonded with a paste are heated in a curing device so that the paste is hardened.

In such a curing device, the heating of the paste generates gases that can cause contamination. These gases flow around the edges of the chips and stick to the chip surfaces in a solid or gaseous form, which eventually could affect the performance of the chips. The gases can also adhere to the surface of heater blocks that are used in the curing device; and if this happens, then the lead frames stick to the heater block.

Conventionally, the contaminant gases are removed by blowing an inert gas, a reducing gas, etc., onto the chips from above. The gas flows around the edges of the chips and then escapes out of the curing device.

This type of method is disclosed in, for example, Japanese Patent Application Laid-Open Nos. 63-239957 and 63-316443. However, the problem of the lead frames sticking to the heater block cannot be completely solved by this method alone.

One method to prevent the lead frames from sticking to the heater block is disclosed in, for example, Japanese Utility Model Laid-Open No. 2-8033. In this method, minute projections which run continuously in the direction in which the lead frames are conveyed are formed on the upper surface of the heater block, and the lead frames are kept above the surface of the heater block with a space in between.

However, in the method described above, the upper surface of the heater block needs to be worked on to form the projections. In addition, the manufacturing and finishing processes of the heater blocks with the projections are difficult and costly. Furthermore, it is impossible to treat all the different types of lead frames always evenly on the projections of the heater block.

More specifically, depending on the number and positions of the chips mounted on each lead frame, the projections of the heater block could be located directly beneath the chips. If this occurs, not all the chips are maintained at a thermally constant distance from the upper surface of the heater block.

In addition, if the chip parts mounted on the lead frames form "islands" (in other words, if the chip parts project downward), the lead frames of the chip parts would be inclined and positioned where the projections on the heater block are located. In this case, it cannot be assured that all the chips are maintained at a constant distance, in terms of heating temperature, from the upper surface of the heater block.

As a result of these problems, in the past, a multiple number of heater blocks are required (one for each type of lead frame to be handled). Furthermore, because of the presence of the projections on the heater block that extend in the feeding direction of the lead frames, the gases between the lead frames and the heater block can only flow in the feeding direction of the lead frames. Thus, the gas discharge efficiency tends to be poor.

SUMMARY OF THE INVENTION

The object of the present invention is to provide a curing device which can manufacture chips inexpensively and can meet the changes in the type of lead frames to be cured.

In order to achieve the object, a curing device of the present invention, in which chips that have been die-bonded to lead frames by a paste are heated while being fed over a heater block of the curing device by a tact-feeding conveyor so as to harden the paste, employs frame supporting wires, which are installed above the heater block in a direction in which the lead frames are fed, and wire slack preventing or wire supporting collars, which are mounted to the frame supporting wires in order to keep a fixed distance between the frame supporting wires and the heater block.

The wire slack preventing collars are slidable on the frame supporting wires and anchored in place by friction, and the frame supporting wires are fastened to wire holding collars which are also slidable on wire holding shafts installed at right angles to the frame supporting wires.

In the curing device of the present invention thus structured, the frame supporting wires are installed above the heater block, and a fixed distance is kept between these frame supporting wires and the surface of the heater block by the wire slack preventing collars. Accordingly, when the lead frames are on the lead frame supporting wires for heating, the gap between the lead frames and the heater block is kept constant. Since such a constant gap is retained between the heater block and the lead frames by the frame supporting wires provided above the heater block and by the wire slack preventing collars provided on the frame supporting wires, the structure is very simple and the manufacturing costs of the device can be very low.

Furthermore, no projections are necessary on the surface of the heater blocks as seen in conventional devices. Therefore, a constant gap in view of the heating temperature can be retained regardless of the type of the chips, and the curing device can perform curing on any type of chip without any difficulty.

In addition, the wire slack preventing collars of the curing device of the present invention are slidable on the frame supporting wires. Accordingly, the collars are positionally adjustable on the frame supporting wires; and even in a case that the pitch of tact (or intermittent) feeding of the lead frames is changed due to the different size of lead frames, the lead frames are prevented from coming onto the wire slack preventing collars if the collars are shifted positionally on the wires.

Furthermore, in the present invention, the frame supporting wires can be moved at right angles relative to the direction the lead frames are conveyed from a bonder. Thus, depending upon the type of lead frames, parts of a lead frame that correspond to the chips are kept so as to not contact the frame supporting wires, and optimal curing conditions are obtainable at all times.

DETAILED DESCRIPTION OF THE INVENTION

Figure 1:
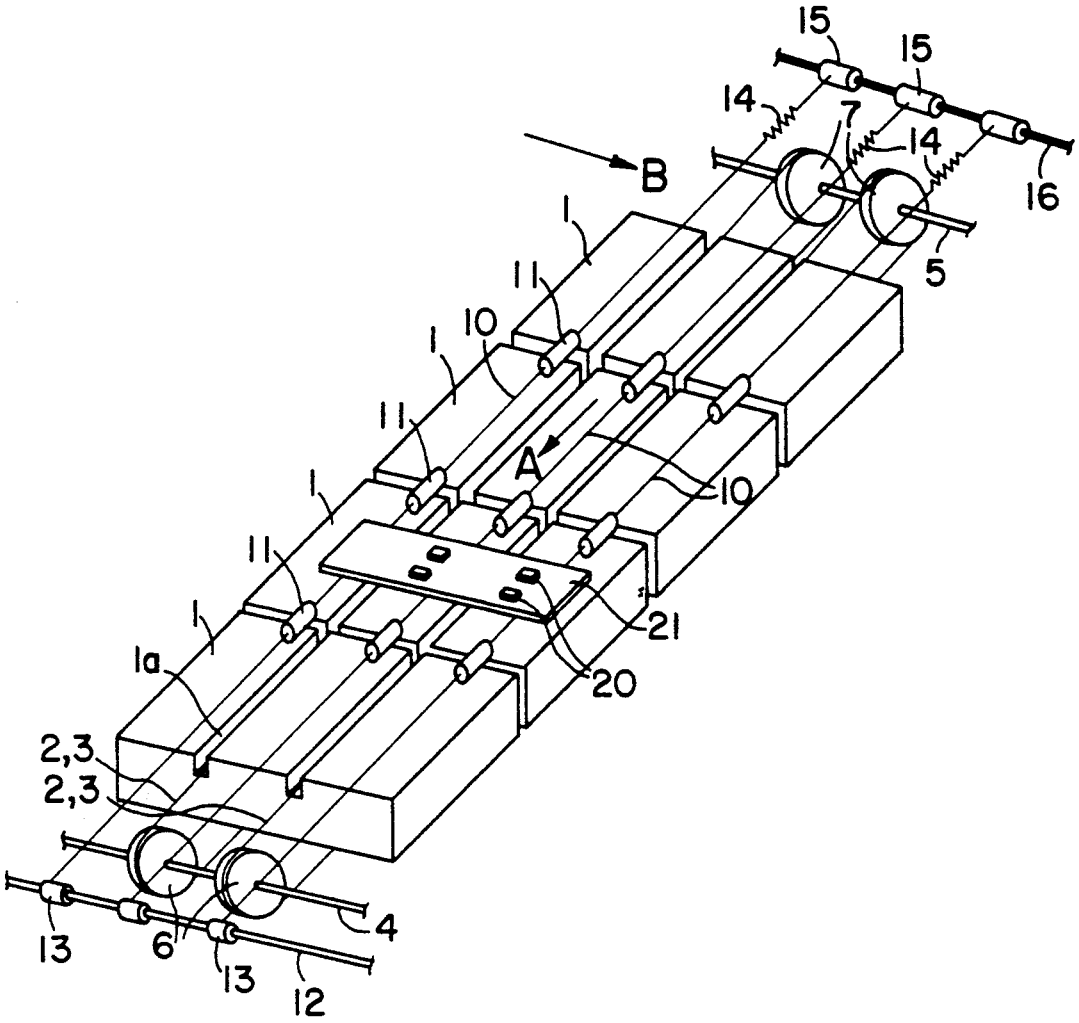
FIG. 1 is a perspective view of the main parts of the curing device of the present invention.

One embodiment of the present invention will be described below with reference to FIGS. 1 and 2:

A multiple number of heater blocks 1 are installed in series inside a curing device, and feeding wire grooves 1*a* are formed in the upper surfaces of the heater blocks 1.

Inside the feeding wire grooves 1*a*, frame feeding wires 3 of a conveyor 2 are installed. The conveyor 2 is comprised of frame feeding wires 3 installed over the pulleys 6 and 7 which are mounted on pulley shafts 4 and 5. The pulley shafts 4 and 5 are rotatable at both ends of the heater blocks. Both of the pulley shafts 4 and 5 are movable up and down by a vertical moving means (not shown), and the pulley shaft 4 is rotated by a driving means (not shown).

Though not shown in the Figures, a cover is placed on the entire assembly of heater blocks 1, and a gas such as an inert gas, a reducing gas, etc., which is heated, is blown onto the upper surfaces of the heater blocks 1 and then discharged to the undersurfaces of the heater blocks 1.

Furthermore, frame supporting wires 10 are installed above the heater blocks 1, and a plurality of wire slack preventing or wire supporting collars 11 are mounted to each frame supporting wire 10 at equal intervals. The collars 11 are anchored by friction on the frame supporting wires 10 so that they are manually slidable on the wires 10.

One end of each frame supporting wire 10 is fastened to each of the wire holding collars 13 which are slidably installed on a first wire holding shaft 12. The other end of each frame supporting wire 10 is fastened, via a tension spring 14, to each of the wire holding collars 15. The wire holding collars 15 are slidable on a second wire holding shaft 16.

Figure 2:
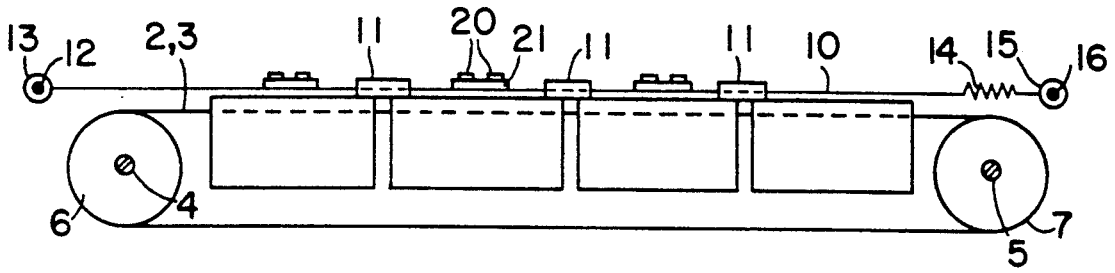
FIG. 2 is a side view thereof.
Figure 3:
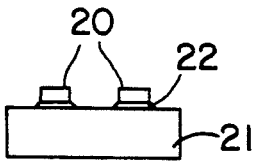
FIG. 3 is a side view of a lead frame with die-bonded chips.

In operation, lead frames 21 (only one is shown in FIG. 1) to which chips 20 have been die-bonded by a paste 22, that is silver, solder, etc., as shown in FIG. 3, are conveyed from a die bonder (not shown) in the direction B, or in the direction of the length of the lead frame 21, and fed onto one end (the upper right end in FIG. 1) of the conveyor 2.

At this moment, the frame feeding wires 3 of the conveyor 2 are positioned above the frame supporting wires 10 and the lead frame 21 sits on the frame feeding wires 3.

Next, the pulley shafts 4 and 5 are rotated a predetermined amount so that the lead frame 21 on the frame feeding wires 3 is fed a fixed distance in direction A which is oriented at an angle of 90 degrees relative to conveying direction B from the die bonder. Then, the conveyor 2 is lowered, thus the lead frame 21 is placed on the frame supporting wires 10. Then, the lead frame 21 is heated for an appropriate time period.

After the heating, the conveyor 2 is raised so that the lead frame 21 is lifted from the frame supporting wires 10 back onto the frame feeding wires 3. Then, the pulley shafts 4 and 5 are rotated a predetermined amount again so that the lead frame 21 is fed to a next heating position, and then the conveyor 2 is again lowered for another heating.

As a result of the tact feeding operation as described above, the lead frame 21 is successively fed in the direction indicated by arrow A.

As described above, the frame supporting wires 10 are positioned above the heater blocks 1 with a predetermined distance in between by the wire slack preventing collars 11, and the lead frames 21 are supported by and on these frame supporting wires 10. Accordingly, the distance between the heater blocks 1 and the lead frames 21 can always be constant by the simple structure, resulting in that the cost of manufacturing the curing device can be greatly reduced.

Furthermore, since no projections are necessary on the surfaces of the heater blocks (as there are in conventional devices), a space between the heater blocks and the lead frames can be consistent in terms of heating temperature regardless of the type of chips to be treated. Thus, the curing device can meet any type of lead frames without difficulty.

Moreover, the distance between the lead frames 21 and the heater blocks 1 can be modified as desired by using wire slack preventing collars of different diameters.

In addition, since there are no projections on the surfaces of the heater blocks, the flow of gases between the lead frames and the heater blocks is not impeded; as a result, the gases can be discharged in all directions, with an extremely good gas discharge efficiency.

As described above, the wire slack preventing collars 11 are anchored in place by friction so as to be slidable on the frame supporting wires 10. Accordingly, the positions of the wire slack preventing collars 11 can be changed by sliding the collars 11 to any desired points on the frame supporting wires 10. As a result, even in a case that the pitch of the tact feeding of the lead frames 21 needs to be changed, the lead frames 21 are prevented from being on the wire slack preventing collars 11.

Moreover, the frame supporting wires 10 are fastened at both ends to the wire holding collars 13 and 15 which are slidable on the wire holding shafts 12 and 16 installed at right angles to the direction of the frame supporting wires 10. Accordingly, depending on the types of lead frames, the distance between the frame supporting wires 10 can be changed by moving the collars at right angles to the feeding direction of the lead frames above the heater blocks. In addition, depending upon the type of lead frames, the parts of the lead frames 21 that correspond to the chips 20 can be prevented from being brought on the frame supporting wires 10. Accordingly, optimal heating conditions are maintained at all times.

As seen from the above, according to the present invention, the frame supporting wires are installed above the heater blocks and in the feeding direction of the lead frames above the heater blocks, and, additionally, the wire slack preventing collars are mounted to the frame supporting wires so as to keep a constant distance between the frame supporting wires and the heater blocks. Accordingly, the curing device of the present invention is simple in structure and is significantly low in manufacturing costs. In addition, the device can meet any size and type of lead frames without any difficulty and have a good gas discharging efficiency.

I claim:

1. A curing device, in which chips which have been die-bonded to lead frames by a paste are heated while being fed over a heater block by a tact-feeding conveyor so as to harden said paste, comprising: frame supporting wires installed above said heater block in a direction in which said lead frames are fed, and wire supporting collars mounted to said frame supporting wires to retain a constant distance between said frame supporting wires and said heater blocks.

2. A curing device according to claim 1, wherein said wire supporting collars are anchored in place by friction so as to be slidable on said frame supporting wires.

3. A curing device according to claim 1, wherein said frame supporting wires are fastened to wire holding collars which are slidably mounted on wire holding shafts installed at right angles relative to said frame supporting wires.

4. A curing device, in which a paste with which chips have been die bonded to lead frames is heated while said lead frames are fed above a heater block, comprising:

a lead frame conveyor for feeding said lead frames above said heater block, said lead frame conveyor being movable in a vertical direction;

frame supporting wires installed above said heater block and parallel to said lead frame conveyor, said lead frames being placed on said frame supporting wires upon a downward movement of said lead frame conveyor and back on said lead frame conveyor upon an upward movement of said conveyor; and wire supporting collars spacedly mounted to said frame supporting wires so as to retain a space between said frame supporting wires and said heater block.

5. A curing device according to claim 4, wherein said wire supporting collars are slidable on said frame supporting wires.

6. A curing device according to claim 4, wherein both ends of said frame supporting wires are fastened to wire holding collars which are slidable on wire holding shafts installed perpendicular to said direction in which said lead frames are fed by said lead frame conveyor.

* * * * *